US008005386B2

(12) United States Patent
Suzuki

(10) Patent No.: US 8,005,386 B2
(45) Date of Patent: Aug. 23, 2011

(54) IMAGE FORMING APPARATUS HAVING DENSITY SENSOR FOR DEVELOPER BEARING MEMBER

(75) Inventor: Shinya Suzuki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 506 days.

(21) Appl. No.: 12/244,113

(22) Filed: Oct. 2, 2008

(65) Prior Publication Data

US 2009/0092403 A1 Apr. 9, 2009

(30) Foreign Application Priority Data

Oct. 4, 2007 (JP) ..... 2007-260660

(51) Int. Cl.
*G03G 15/08* (2006.01)

(52) U.S. Cl. ..... 399/64

(58) Field of Classification Search ..... 399/61, 399/62, 64, 65; 118/691
See application file for complete search history.

(56) References Cited

U.S. PATENT DOCUMENTS 3,830,401 A * 8/1974 Benwood et al. ..... 222/57
4,155,638 A * 5/1979 Blitzer ..... 399/59
4,313,671 A * 2/1982 Kuru ..... 399/60
4,417,544 A * 11/1983 Nishimura ..... 399/64
4,451,135 A * 5/1984 Okumura ..... 399/65
4,550,998 A * 11/1985 Nishikawa ..... 118/691
4,551,002 A * 11/1985 Aoki et al. ..... 118/691
4,648,702 A * 3/1987 Goto ..... 399/65
4,804,996 A * 2/1989 Snelling ..... 399/65
4,883,019 A * 11/1989 Menjo et al. ..... 118/691
5,216,469 A * 6/1993 Yamada ..... 399/59
5,402,209 A * 3/1995 Itoyama et al. ..... 399/46

FOREIGN PATENT DOCUMENTS

JP 63148282 A * 6/1988
JP 1-186983 A 7/1989
JP 5-313495 A 11/1993
JP 5-313496 11/1993
JP 05302892 A * 11/1993
JP 2002-91156 A 3/2002

* cited by examiner

*Primary Examiner* — Robert Beatty
(74) *Attorney, Agent, or Firm* — Fitzpatrick, Cella, Harper & Scinto

(57) ABSTRACT

In an image forming apparatus having a toner density sensor which emits light to a developer carried on a developing sleeve and which detects developer density by a reflection output value from the developer, when a reflection output value when the developer is initially set with respect to the illumination light of the toner density sensor is defined as A and a reflection output value of a region of at least the developing sleeve which is opposed to the toner density sensor when the developer is not carried on the developing sleeve is defined as B, a value of B/A is in a range of 0.3<B/A<2.

6 Claims, 8 Drawing Sheets

*FIG. 7*

| Developing sleeve | Sensor output from sleeve only | B/A | Evaluation | Problem |
|---|---|---|---|---|
| Resin sleeve a | 0.10 | 0.10 | △ | White ground portion fog |
| Resin sleeve b | 0.31 | 0.31 | ○ | No problem |
| Resin sleeve c | 1.15 | 1.15 | ○ | No problem |
| Resin sleeve d | 1.98 | 1.98 | ○ | No problem |
| Resin sleeve e | 2.40 | 2.40 | △ | Thin in density |
| Aluminum (ARD) 10 μm | 5.56 | 5.56 | × | Thin in density/Carrier adhered |
| Aluminum (FGB) 10 μm | 6.78 | 6.78 | × | Thin in density/Carrier adhered |
| SUS (ARD) 10 μm | 3.62 | 3.62 | × | Thin in density/Carrier adhered |

*FIG. 8*

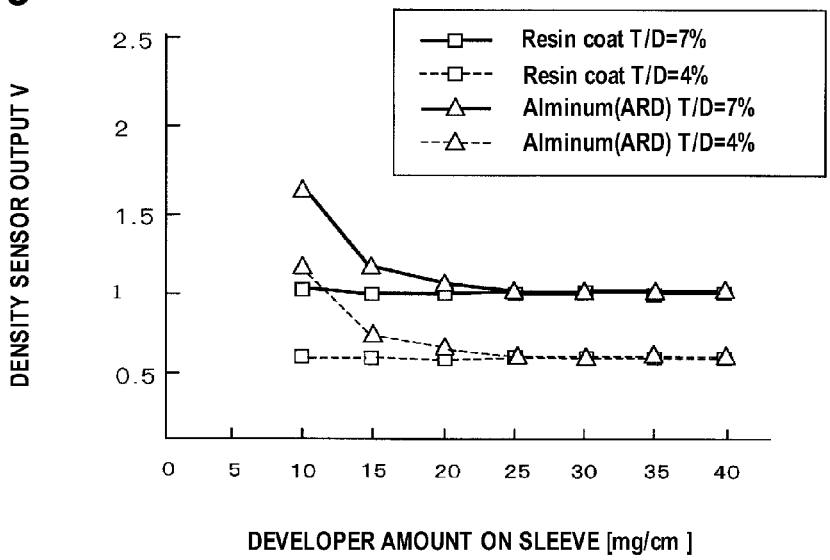

IMAGE FORMING APPARATUS HAVING DENSITY SENSOR FOR DEVELOPER BEARING MEMBER

BACKGROUND OF THE INVENTION

1. Field of the Invention

The present invention relates to an image forming apparatus utilizing an electrophotographic system, and more particularly, to an image forming apparatus using two-component developer in which toner and carrier are mixed for developing device which develops an electrostatic image formed on an image bearing member.

2. Description of Related Art

In a conventional image forming apparatus of an electrophotographic system, there is known a technique in which an electrostatic image formed in the image bearing member is developed using a developer by means of a development device, thereby making the image visible as a toner image. For the development device using the two-component developer in which toner and carrier are mixed as the developer, in order to obtain stable developing characteristics, it is important to keep constant a mixing ratio T/D ratio (D=T+C) (indicating toner density of developer, T/D ratio, hereinafter) of toner (T) and carrier (C) of the developer.

The toner in the developer is consumed at the time of development, and the T/D ratio of the developer is changed. Therefore, it is necessary to appropriately detect the T/D ratio of the developer in the development device, supply toner in accordance with the variation, always control the T/D ratio of the developer constant, and to maintain the quality of image.

Thus, several systems such as light reflection detecting system, an inductance system and a patch detection system have been proposed as developer density detection/control apparatuses (ATR).

In these systems, infrared-emitting LED (light-emitting diode) emits infrared light, and the reflection light is received by a light receiving element, e.g., a PD (photodiode). Many image forming apparatuses using the light reflection detection system which detects the T/D ratio of a developer by measuring the amount of reflection light are used (Japanese Patent Application Laid-open No. 2002-091156).

This is based on a principle that toner reflects infrared light carrier and carrier absorbs infrared light, and if the amount of toner is increased, the reflection light amount is increased, and if the amount of toner is reduced, the reflection light amount is also reduced. Therefore, if the supply amount of toner is adjusted such that the reflection light amount becomes a constant value, the T/D ratio of the developer can be maintained at a constant level.

In a full color image forming apparatus, a development device having a plurality of development devices using developers of different colors is used. Among them, a color image forming apparatus for forming a full color image requires development devices of three colors, i.e., yellow, magenta and cyan, or four colors including black.

If the plurality of development devices are respectively provided with a developer density detecting unit, the same number of developer density detecting units as that of the development devices is required. Further, the same number of signal processing circuits which processes a detection signal from the developer density detecting unit and outputs a developer (toner) supply signal as that of the developer density detecting unit is required. Thus, the structure of the apparatus is complicated, and cost is largely increased.

To solve this problem, the apparatus has a moving type development device which can move a specific development device at the time of developing operation to develop, and a light reflection detecting unit detects a developer carried on a developer bearing member of the development device. An image forming apparatus capable of controlling the T/D ratio of each developer using a single developer density control apparatus is proposed (see Japanese Patent Application Laid-open No. 05-313495).

In the developer density control (ATR) of the conventional light reflection detection system, however, the output of the light reflection detecting unit is largely varied by variation of the developer coat amount carried on a developing sleeve which is the developer bearing member of the development device. Thus, there is an adverse possibility that a value is erroneously be detected.

The developer coat amount which is carried on the developing sleeve is varied by variation in fluidity of developer caused by a large amount of image forming operation, variation in surface properties (surface roughness, friction coefficient) of the developing sleeve, and an image ratio of an output image.

In the conventional image forming apparatus, as a material of the developing sleeve, aluminum or stainless steel (SUS) provided at its surface with projections and depressions to enhance bearing and transportation ability of developer is frequently used.

In such a developing sleeve, if the coat amount of developer carried on its surface is reduced, the surface is exposed. In addition, the material such as aluminum and stainless steel constituting the developing sleeve has high reflection coefficient, the reflection light from the developing sleeve surface is increased when the developer density is detected by the light reflection detecting unit. Thus, if the developer density is high, erroneous detection is caused, and control for reducing the supply amount of toner is adversely performed to reduce the developer density by the developer density control.

As a result, the developer coat amount on the developing sleeve is reduced and developing performance is deteriorated, and the developer density is reduced by the developer density control. Therefore, the developing performance is abruptly deteriorated, the image density is reduced and carrier is adhered.

SUMMARY OF THE INVENTION

Hence, it is an object of the present invention to provide a high quality image forming apparatus capable of controlling so as to precisely detect the developer density of a developer and to maintain the appropriate state, and capable of outputting an image with stable image density.

To achieve the above object, an image forming apparatus comprising:

an image bearing member, a development device which develops an electrostatic image formed on the image bearing member, a developer bearing member which is provided in the development device so as to be opposed to the image bearing member, and which carries a developer, a density sensor which emits light to the developer bearing member on the surface that carries the developer, and which can detect developer density on the developer bearing member by a reflection output value of the developer, and a supply device which supplies a supply developer to the development device in accordance with a detection result of the density sensor, wherein if a reflection output value detected by the density sensor in a state where the developer is carried on the developer bearing member is defined as A and a reflection output value detected by the density sensor in a state where the developer is not carried on the developer bearing member is defined as B, a value of B/A is in a range of $0.3<B/A<2$.

Further features of the present invention will become apparent from the following description of exemplary embodiments (with reference to the attached drawings).

BRIEF DESCRIPTION OF THE DRAWINGS

FIG. 7 is a diagram illustrating a result of evaluation of the image forming apparatus illustrated in FIG. 1;

FIG. 8 is a graph illustrating a relation between the amount of developer carried on the developing sleeve and output by a toner density sensor when a toner density sensor is disposed so as to opposed between magnetic poles;

DESCRIPTION OF THE EMBODIMENTS

An embodiment of the present invention will be described in detail based on the drawings.

First Embodiment

Figure 1:
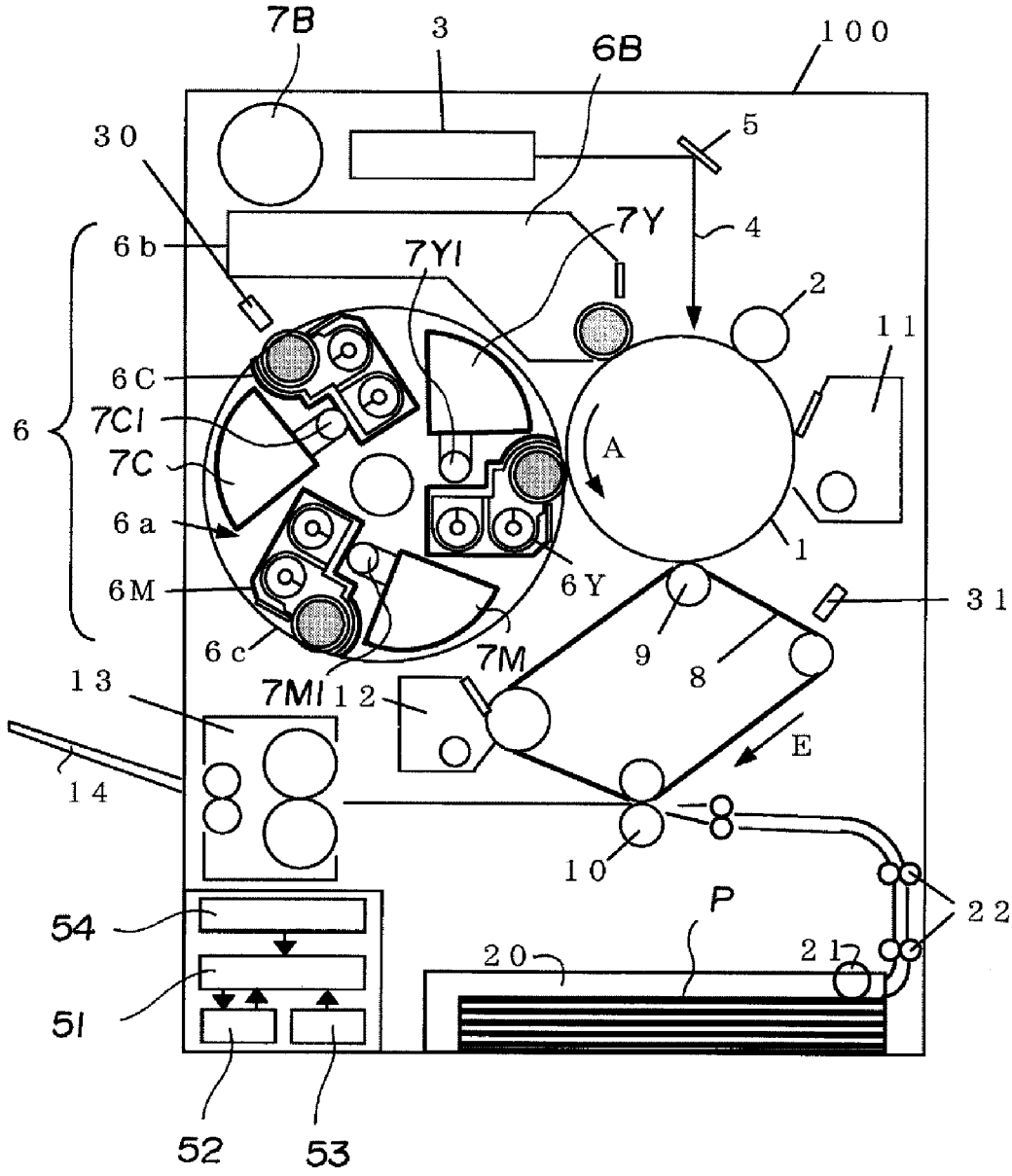
FIG. 1 is a schematic diagram illustrating a structure of an image forming apparatus according to an embodiment of the present invention.
Figure 2:
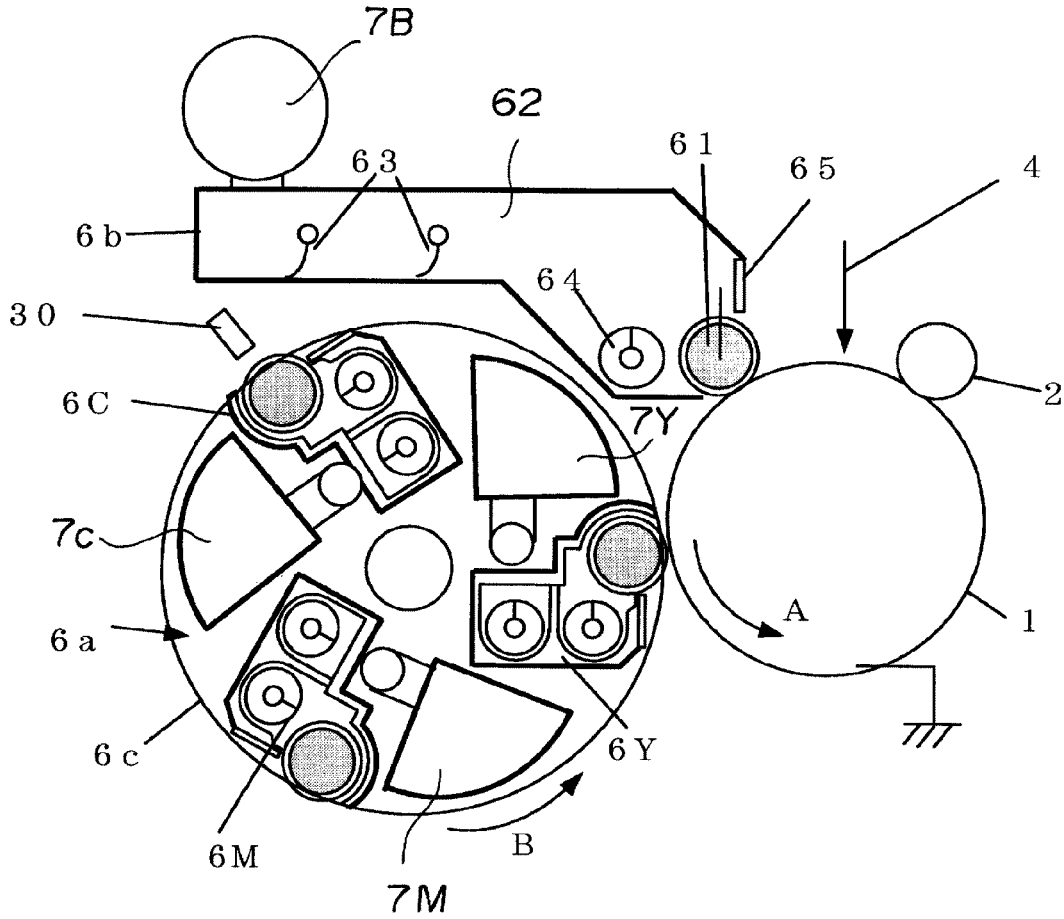
FIG. 2 is a schematic diagram illustrating a structure of an image forming portion illustrated in FIG. 1.

FIG. 1 is a schematic diagram showing a structure of an electrophotographic image forming apparatus according to the embodiment of the present invention. FIG. 2 is a schematic diagram showing a structure of the image forming portion.

In the electrophotographic image forming apparatus according to the embodiment, as shown in FIG. 1, a photosensitive drum 1 which is an image bearing member formed with a photosensitive layer made of organic photosensitive member formed on a cylindrical base body is rotatably mounted with a predetermined circumferential velocity in a direction of the arrow A in FIG. 1. In this embodiment, a photosensitive layer is formed of organic photosensitive material into an aluminum cylindrical shape having outer diameter of 50 mm, and a surface protection layer is provided to enhance mold-releasing performance of toner and to prevent the photosensitive layer from being cut.

A peripheral surface of the photosensitive drum 1 is uniformly charged to predetermined polarity and electric potential by a charging roller 2 which is a charging unit. The charging surface is scanned and exposed to light by a laser light 4 which is output from exposing unit 3, thereby forming an electrostatic image of image information. The laser light 4 is modulated (ON/OFF conversion) in correspondence with a picture element signal of image information which is input from an image reading apparatus (not shown) or an image signal generating apparatus such as a personal computer through a print interface.

A laser light reflection mirror 5 deflects laser light 4 which is output from the exposing unit 3 to the photosensitive drum 1. A developing unit 6 includes a switching type rotation developing unit 6*a* of a yellow toner development device 6Y, a magenta toner development device 6M and cyan toner development device 6C, and a stationary developing unit 6*b* having a black toner development device 6B for black.

The rotation developing unit 6*a* is supported by a rotation support apparatus 6*c* such that the rotation developing unit 6*a* can rotate in a direction of the arrow B, the color toner development devices 6Y, 6M and 6C are sequentially opposed to the photosensitive drum 1, and development is carried out by respective color toner.

Toner (supplying developer) is supplied to the color toner development device by color toner cartridges 7Y, 7M and 7C. The color toner cartridges 7Y, 7M and 7C can be attached to and detached from the apparatus main body 100. The supplying developer in the color toner cartridge is supplied to the development device when conveying screws 7Y1, 7M1 and 7C1 which are conveying members are driven. The driving operation of driving unit (e.g., motor) which drives the supplying screw is controlled by a control unit 51. In this embodiment, the supplying apparatus is constituted by the supplying screw, the driving unit and the like. When the color toner cartridges 7Y, 7M and 7C become empty of toner, the color toner cartridges are replaced by new ones and images can be formed again.

The stationary developing unit 6*b* has a development device in which black toner is accommodated. The amount of black toner consumed is high. Like the rotation developing unit 6*a*, the stationary developing unit 6*b* includes a black toner cartridge 7B. Toner is supplied to the black toner cartridge 7B and the black toner development device 6B, and the black toner cartridge 7B can be attached to and detached from the apparatus main body.

In a state where the stationary developing unit 6*b* is mounted on the apparatus main body, as shown in FIG. 2, a developing sleeve 61 which is a rotatable toner bearing member at a fine distance (100 μm to 500 μm, in this embodiment) between the developing sleeve 61 and the photosensitive drum 1. A developing region for supplying toner carried on the developing sleeve 61 toward the photosensitive drum 1 is formed.

A sending unit 63 for sending toner toward the developing sleeve 61 is provided in the black developing container 62. Toner supplied from the black toner cartridge 7B by the sending unit 63 is conveyed toward the developing sleeve 61, and the toner is supplied to the developing sleeve by a supplying screw 64 which supplies toner to the developing sleeve 61.

A developing blade 65 as a limiting member which limits a layer thickness of toner carried on the developing sleeve 61 is provided above the developing sleeve 61.

In the structure of the developing unit, a surface of the photosensitive drum 1 is uniformly charged by the charging roller 2 (about −600 V in this embodiment). Next, exposure and scanning are carried out by the exposing unit 3 which is ON/OFF controlled in accordance with image data of first color (e.g., yellow), and an electrostatic latent image (about −100 V in this embodiment) of the first color is formed on the photosensitive drum 1.

The electrostatic latent image of the first color is developed and visualized by the yellow toner development device 6Y having yellow toner (− polarity) of the first color. The visualized first toner image is brought into contact with the photosensitive drum 1 under predetermined pressure. In a nip portion with respect to an intermediate transfer belt 8 which is rotated and driven in the direction of the arrow E with substantially the same velocity (200 mm/S) as the circumferential velocity of the photosensitive drum 1, the primary transfer is carried out on the intermediate transfer belt 8.

In this embodiment, a polyimide belt was used as the intermediate transfer belt 8, a surface resistance of thickness of 100 μm of endless shape was adjusted to $1\times10^{12}$ Ω/square, and a volume resistance was adjusted to $1\times10^{9}$ Ω·cm.

The primary transfer member 9 is made of high polymer elastomer material such as rubber and urethane in which cored bar and ion conductive material such as sodium perchlorate are mixed, or elastic material such as high polymer foam material. A volume resistance value of the roller was $1\times10^{6}$Ω·cm (23° C./50% RH environment or lower).

A material having the same structure was used as a secondary transfer member 10, and a volume resistance value of the roller was $1\times10^{8}$ Ω·cm (23° C./50% RH environment or lower).

At the time of the primary transfer to the intermediate transfer belt 8, a preset voltage (+100 V in this embodiment) having polarity opposite from the charged polarity of toner (−) is applied to the intermediate transfer belt 8. Toner which was not transferred to the intermediate transfer belt 8 and remained on the photosensitive drum 1 at the time of the primary transfer is scraped off by a cleaning blade which is cleaning unit 11 that is in pressure contact with the photosensitive drum 1, and is collected in a waste toner container (not shown).

The above-described transfer step is repeated for other toner (magenta, cyan and black), toner image created by toner of different color included in the development device is sequentially primary transferred to the intermediate transfer belt 8, the toner images are laminated and a color image is synthesized and formed.

Transfer materials P as to-be recorded materials are supplied to the intermediate transfer belt 8 from a sheet cassette 20 by a sheet roller 21 and a conveying roller 22 one-sheet by one-sheet. By applying a voltage (+1000 V in this embodiment) having polarity opposite from the toner is applied to the secondary transfer member 10 from the back surface color toner of the transfer material P, a full color toner image on the intermediate transfer belt 8 is secondary transferred to the transfer material P, and a full color toner image is formed on the transfer material P.

The transfer material P on which the full color toner image was transferred is separated from the intermediate transfer belt 8 and introduced into a fixing unit 13, the toner image is heated and fixed to the transfer material P and it is discharged into a discharge tray 14.

Secondary transfer-remaining toner which was not secondary transferred to the transfer material P from the intermediate transfer belt 8 is removed from the intermediate transfer belt 8 by the intermediate transfer belt cleaner 12.

Next, the color toner development device will be described based on FIG. 3 which shows the yellow toner development device 6Y in an enlarged scale. Since the magenta toner development device 6M and the cyan toner development device 6C also have the same structure, explanation thereof will be omitted.

Figure 3:
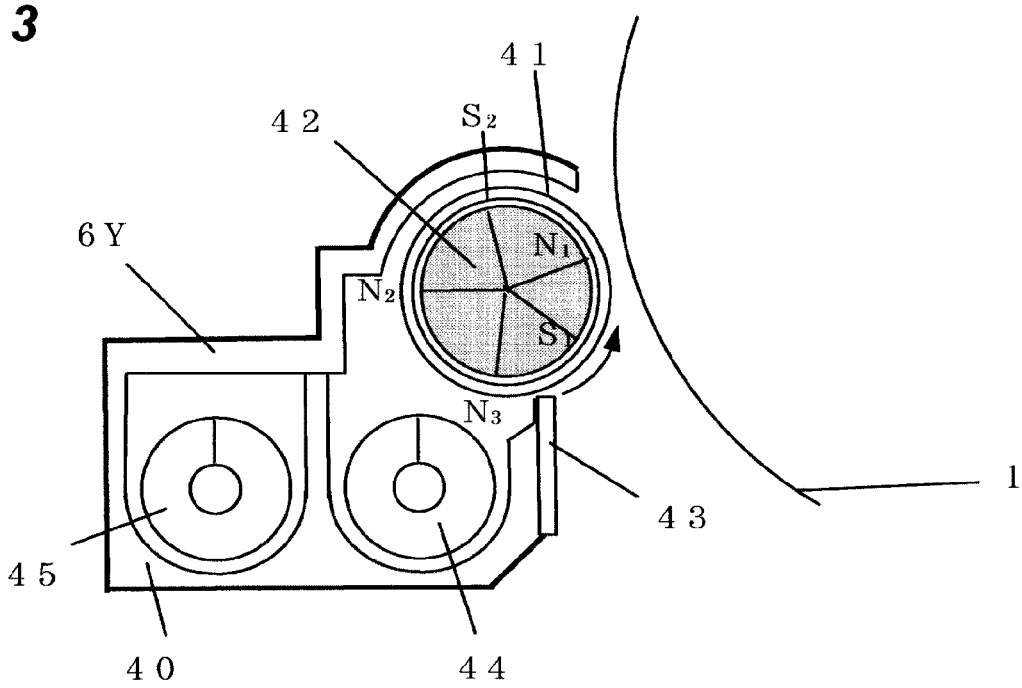
FIG. 3 is a sectional view of a development device illustrated in FIG. 2.

FIG. 3 shows a developing sleeve 41, a magnet roller 42 fixed to and disposed in the developing sleeve, stirring screws 44 and 45, a limiting blade 43 for thinly forming a developer on a surface of the developing sleeve, and a developing container 40.

A developing step for visualizing the electrostatic latent image by two-component magnetic brush method and circulation of developer will be described using the development device 6Y.

As the developing sleeve 41 rotates, a developer near the stirring screw 44 pumped up by a magnetic pole N3 of the magnet roller 42 is conveyed to the magnetic pole S1. In this process, the limiting blade 43 disposed at the S-B gap from the developing sleeve 41 limits. A thin layer is formed on the developing sleeve 41.

When this thinly formed developer is conveyed to a developing main pole N1 disposed near a closest position to the photosensitive drum 1, a magnetic brush (ear) is formed by a magnetic force, and the electrostatic latent image on the photosensitive drum 1 is developed by the magnetic brush which is formed into the ear. The developer on the developing sleeve 41 which completed the developing operation is collected into the developing container 40 by repulsion magnetic fields of magnetic poles N2 and N3 downstream in a rotation direction of the developing sleeve.

In this embodiment, the S-B gap between the developing sleeve 41 and the limiting blade 43 is set such that the amount of developer which is thinly formed on the developing sleeve 41 becomes about 30 mg/cm$^2$ as an initially set value.

This is because that in the image forming apparatus of the embodiment, if the amount of developer becomes greater than 40 mg/cm$^2$, residence of developer between the developing sleeve and the photosensitive drum and adhesion of carrier to the photosensitive drum are deteriorated.

As developers accommodated in the color toner development devices 6Y, 6M and 6C, a two-component developer in which magnetic carrier and non-magnetic carrier are mixed at predetermined mixing ratio is used. As the magnetic carrier, ferrite magnetic carrier having 24 Am2/kg saturation magnetization with respect to 240 kA/m impressed magnetic field, $1\times10^{7-8}$ Ω·cm specific resistance in 3000 V/cm field intensity, and weight average particle diameter of 50 μm was used. As the non-magnetic toner, negatively charged polyester-based resin toner having weight average particle diameter of 7.2 μm in which hydrophobic colloidal silica is added to coloring resin particle was used.

As the magnetic carrier, it is possible to use a resin magnetic carrier produced by polymerization method while using binder resin, magnetic metal oxide and non-magnetic metal oxide as starting raw materials. A producing method of these magnetic carriers is not especially limited.

Further, styrene acryl-based resin toner may be used as the non-magnetic toner. A mixture in which the magnetic carrier and the non-magnetic toner were mixed with a weight ratio of 93:7 (toner density: 7%) was used as the developer.

A developer accommodated in the black toner development device 6B is a magnetic single component developer, and a magnetic single component crushed toner including conventionally widely used carbon black, magnetite and the like is used as the magnetic toner. A particle diameter of the crushed toner is about 8 μm.

Next, a toner density sensor and operation concerning development device control (ATR) which is carried out in the embodiment will be described.

As shown in FIG. 1, an image forming apparatus 100 of the embodiment has a CPU 51 which controls the image forming apparatus. A RAM 52 used as a working memory, a ROM 53 in which a program executed by the CPU and various data sets are stored, and a toner density sensor control unit 54 are connected to the CPU 51. Alight reflection type toner density sensor (developer density detecting unit) 30 is disposed so as to be opposed to the rotation developing unit 6*a* downstream of a rotation direction B of the rotation developing unit 6*a* from the position where the photosensitive drum 1 and the rotation developing unit 6*a* are opposed to each other. The light reflection type toner density sensor (developer density detecting unit) 30 detects an amount of reflection light of developer color carried on the developing sleeve. By this detection, it is possible to know a ratio of toner and carrier in the developer, i.e., a toner density. The supply apparatus is driven and supply of toner is controlled in accordance with a result of detection of the light reflection type toner density sensor 30, thereby controlling the toner density in the development device.

Figure 4:
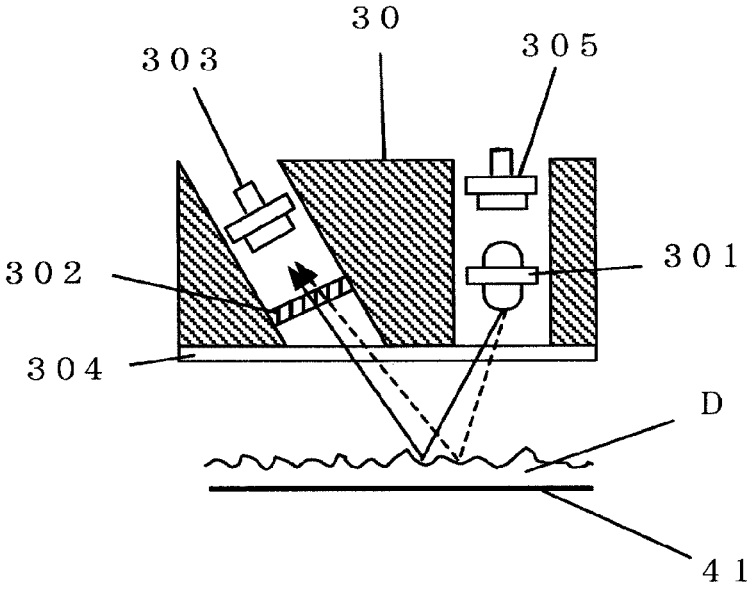
FIG. 4 is a schematic diagram of a structure of a toner density sensor illustrated in FIG. 2.

FIG. 4 shows an example of a schematic structure of the toner density sensor 30. The toner density sensor 30 includes a first light receiving element 303 and a second light receiving element 305. The toner density sensor 30 is diffused light type density detecting unit which detects diffused light from a subject.

The first light receiving element 303 is a photodiode disposed behind a two-way light emitting type LED 301 and a infrared light transmissive filter 302 as an infrared light emitting element. The second light receiving element 305 is a is a photodiode which directly receives infrared light emitted rearward from the LED 301 behind the transparent plate 304 and the LED 301. The term "transparent" used herein means that infrared light passes through.

A halogen lamp, an infrared light emitting LED element, and element are used as the luminous element 301, and infrared light (wavelength: $\lambda$=960 nm) is emitted as illumination light. As the light receiving elements 303 and 305, a silicon-based photoelectric conversion element (such as photodiode and phototransistor) having high sensitivity at infrared portion is used. The infrared light transmissive filter 302 is not always necessary, and the transparent plate 304 may also function as a filter 302. Alternatively, the light receiving elements 303 and 305 may be integrally formed as one piece.

Next, toner density detecting operation by the toner density sensor 30 will be described briefly. Infrared light emitted from the luminous element 301 is emitted onto the two-component developer layer D carried while it is thinly formed on an outer peripheral surface of the developing sleeve 41. The reflected diffused reflection light is received by the light receiving element 303 by toner component in the developer layer D, the detection output is processed by the CPU 51, and the toner density of the developer is measured.

The widely used color non-magnetic toner such as yellow, magenta and cyan reflects infrared light, and since magnetic carrier (such as ferrite carrier, magnetic material diffusion type resin carrier) has color phase closer to black, the magnetic carrier has characteristics which absorb infrared light. Therefore, as the amount of reflection light is higher, the amount of toner in the two-component developer is higher, and toner density of developer is higher.

A detection signal from the second light receiving element 305 is used as a reference signal when toner density of developer is detected, and is used for light amount control and calculation processing for making the amount of light of luminous element to be emitted to the developer constant.

The luminous element 301 which is the light emitting source has temperature characteristics, and as the temperature becomes higher, the radiation light amount is reduced. If output values of LED 301 and light receiving elements 303 and 305 are varied due to temperature variation in environment, light amount of the first and second infrared light from the LED 301 are varied in the same manner, and characteristics of the first and second light receiving elements 303 and 305 are also varied in the same manner.

Hence, a result of comparison between detection outputs of both the light receiving elements using the detection output of the second light receiving element 305 as a reference does not have influence caused by the temperature variation at all, and even if the emitting amount of LED is varied due to the temperature variation in environment, it is possible to always stably measure the toner density precisely.

It is preferable that the first infrared light and second infrared light emitted from the LED 301 are set to the same value, the first and second light receiving element 303 and 305 are of the same type and substantially having the same characteristics.

Figure 5:
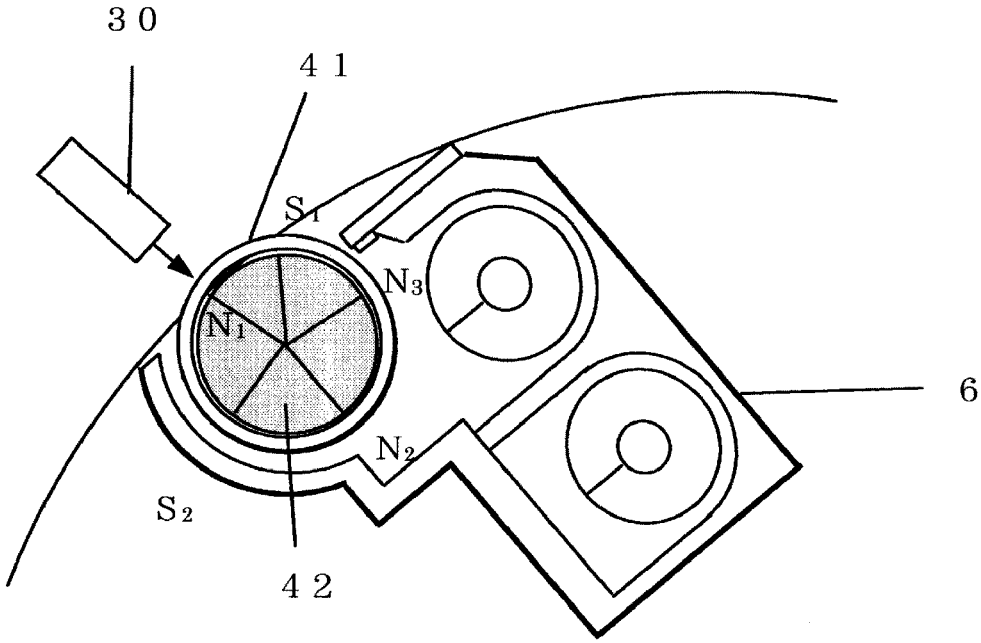
FIG. 5 is a diagram illustrating a disposition position of the toner density sensor illustrated in FIG. 4.

FIG. 5 shows disposition position of the toner density sensor 30 with respect to the color toner development devices 6Y, 6M and 6C in the image forming apparatus 100 of the embodiment.

As shown in FIG. 5, in the embodiment, illumination light from the LED 301 is emitted to the developing main pole N1 or to a portion near the developing main pole N1. The illumination position by the toner density sensor may be between the adjacent magnetic poles, in the magnetic brush by the developer on the developing sleeve 41, an ear stands or falls. However, if the output value with respect to the toner density is set in the respective states, it is possible to detect substantially in the same manner.

Next, developer density control (ATR) in the embodiment will be described.

The color toner development devices 6Y, 6M and 6C in which starter developer is charged at the time of initial disposition are mounted on the image forming apparatus 100, and the initial operation of the developer density control is carried out. In the starter developer, the magnetic carrier and non-magnetic toner are mixed such that the toner density (T/D ratio) becomes 7%.

The developing sleeve 41 and the S-B gap of the limiting blade 43 are adjusted such that the amount of developer near the developing main pole N1 carried on the developing sleeve of the color toner development devices 6Y, 6M and 6C becomes 30±5 mg/cm$^2$.

In the initializing operation, illumination light is emitted by the LED 301 in the toner density sensor 30 to the starter developer carried on the developing sleeves 41 of the color toner development devices 6Y, 6M and 6C. The light receiving element 303 detects reflection light, and it is sequentially recorded in the RAM 52 as output values of the toner density sensor of yellow, magenta and cyan corresponding to toner density 7%.

The illumination light intensity of the toner density sensor at the time of initializing operation is detected by the light receiving element 305 in the toner density sensor 30, and is stored in the RAM 52 in the same manner. A battery (not shown) is provided in the RAM 52, and the battery is backed up. The initializing operation is carried out after the image forming apparatus is disposed. Alternatively, the initializing operation may be carried out after the development device is replaced by new one.

The initializing operation of developer density control is completed, the image forming operation is started, and a color image is output. Whenever the color toner development devices 6Y, 6M and 6C are conveyed to detection positions of the toner density sensor 30 as the rotation developing unit 6*a* rotates, toner density is detected with respect to a developer carried on the developing sleeve.

When the output detected by the toner density sensor 30 is low with respect to the reference value (output with respect to toner density 7%) which is set by the initializing operation, it is determined that the toner density in the developer is low, and toner is supplied such that toner density becomes high.

When the output by the toner density sensor is high with respect to the reference value on the contrary, it is determined that the toner density in a developer is high, and toner is supplied such that the toner density becomes low. Supply of toner is controlled depending upon how much toner in the color toner cartridges 7Y, 7M and 7C is supplied into the color toner development devices 6Y, 6M and 6C. Control is performed such that toner density of developer falls within a predetermined range.

In the image forming apparatus of the embodiment, control is performed such that the toner density of developer falls within a range of 3% to 12%. This is because that if the toner density exceeds 12%, a problem such as scatter of toner or white ground portion fog occurs. If the toner density is less than 3%, a problem such as thin image density or adhesion of carrier occurs.

Next, the developing sleeve 41 used in the embodiment will be described. In this embodiment, base material of the developing sleeve 41 is aluminum pipe, a region of its surface which carries and conveys the developer is formed with conductive resin film layer. Graphite, carbon black and quaternary ammonium salt were dispersed in phenol resin as main component of film layer as the resin film layer. In this embodiment, application liquid in which phenol resin, crystalline graphite and carbon were mixed at weight ratio of 100:36:4 on the sleeve surface was applied with film thickness of 10 μm, it was hardened at the temperature of 150° C. environment. The volume specific resistance of the resin layer was measured by four edge needle mensuration and it was $0.8\times10^2$ Ω·cm, and its surface resistivity was $1.2\times10^3$ Ω/square.

Aspherical carbon particle having average particle diameter of 12 μm was used as carbon black to be dispersed, and it was formed such that ten point average roughness Rz by JISB0601 of resin film layer became about 10 μm. A contact type surface roughness meter [manufactured by Kosaka Laboratory Ltd.: Surf coder SE-3300] was used for measuring the surface roughness of the resin film layer. The measuring conditions were that a cut off value was 0.8 mm, a measuring length was 2.5 mm, sending speed was 0.1 mm/second, and magnification was 5000 times.

Here, qualitatively, Rz shows a difference in height between mountain and valley of projections and depressions on the surface of the developing sleeve. In this embodiment, phenol resin was used as the main component of the film layer, it is also possible to use epoxy resin, styrene acryl resin, polycarbonate resin, PMMA, and acrylic melamine resin.

Next, effect of the embodiment will be described based on FIGS. 6 to 8.

Figure 6:
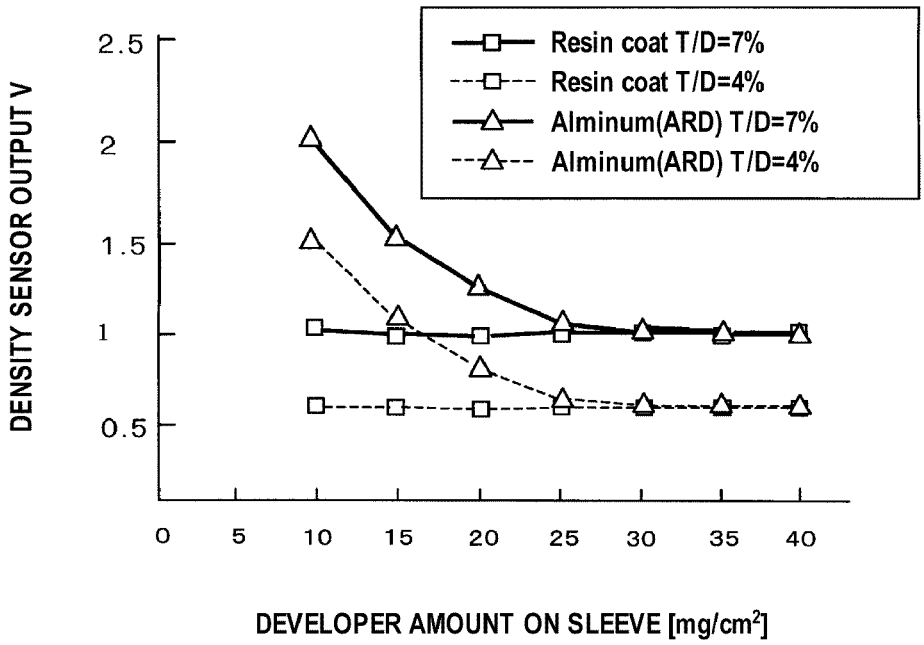
FIG. 6 is a graph illustrating a relation between a developer amount carried on a developing sleeve and output by the toner density sensor when the toner density sensor is disposed opposed to a magnetic pole.

FIG. 6 is a graph showing output characteristics by the toner density sensor 30 when an amount of developer near the developing main pole N1 carried on the developing sleeve 41 was varied.

Here, a square in the graph represents output when a resin coat sleeve formed with resin film layer on a developing sleeve surface as the developing sleeve 41, and a triangle represents output when a conventionally widely used aluminum sleeve was used.

As the aluminum sleeve, indefinite shape alumina particle (ARD) was used as grain, it was subjected to blast processing, the surface was subjected to rough surface processing, ten point average roughness Rz was about 10 μm. The solid line in the graph shows output when the toner density of developer carried on the developing sleeve was 7%, and the broken line shows output when the toner density was 4%.

In FIG. 6, when a resin coat sleeve is used as the developing sleeve 41, even if the amount of developer on the developing sleeve is changed, output of the developing sleeve with respect to developer of toner density of 7% is stably about 1.0 V within a range of 10 to 40 mg/cm$^2$. Output of developing sleeve with respect to developer of toner density of 4% was stably about 0.6 V.

That is, variation of Δ0.13 V is found in output of the toner density sensor with respect to variation of Δ1% toner density, and toner density can be detected by this output difference, and the amount of developer on the developing sleeve is not affected.

On the other hand, if an aluminum sleeve is used, the same characteristics as those of the resin coat sleeve can be found in a range where the amount of developer on the developing sleeve is 25 to 40 mg/cm$^2$. However, if the amount of developer becomes smaller than 25 mg/cm$^2$, when the amount of developer on the sleeve is 10 mg/cm$^2$, the output of the density sensor was 2.0 V with respect to developer having toner density of 7%.

This corresponds to output of toner density of 14.5% in a range where the amount of developer on the developing sleeve is 25 to 40 mg/cm$^2$.

For these two kinds of developing sleeves, the detection conditions of the toner density sensor are set the same as this consideration, and output by the toner density sensor was measured when no developer was carried on the developing sleeve. As a result, the output was 1.15 V in the case of the resin coat sleeve, and the output was 5.56 V in the case of the aluminum sleeve.

That is, a cause of this erroneous detection is that the entire surface of the developing sleeve is covered with the developer when the amount of developer on the developing sleeve is 25 mg/cm$^2$ or higher. With this, although the reflection light by pure developer can be detected, but as the amount of developer is reduced, it appears on the sleeve surface and thus, reflection light of both colors of the developer and developing sleeve are detected.

In the case of aluminum sleeve, since the reflection output of the sleeve itself is equal to output when the toner density is high, erroneous detection occurs if a slight reflection output appears on the sleeve surface. In the case of the resin coat sleeve, on the other hand, since the reflection output of the sleeve itself is almost equal to output within a range of toner density which is controlled by the developer density control. Therefore, even if the amount of developer on the developing sleeve is reduced, erroneous detection of toner density does not occur almost at all.

This aluminum sleeve was used as the developing sleeve, output of color images were repeated while controlling the developer density by the image forming apparatus, and the following problems were generated. That is, the amount of developer carried on the developing sleeve is adversely varied due to variation in flowability of developer caused by a large amount of image forming operations, surface properties (surface roughness, friction coefficient) of developing sleeve, and image ratio of output image.

Due to these conditions, the amount of developer coated on the developing sleeve is reduced to 15 mg/cm$^2$. At that time, the control must be performed under the condition that initial toner density 7% is used as a reference value by developer density control, it is erroneously detected that the developer density is high due to the above reason, control is performed so as to reduce the toner supply amount. The toner density was reduced lower than 3%, and image failures such as thin density of image and adhesion of carrier were generated.

On the other hand, an image forming apparatus using the resin coat sleeve did not have the above problem. In this consideration, the rough surface processing of aluminum sleeve surface was subjected to blast processing using glass bead particle (FGB), the ten point average rough Rz was set to about 10 μm, and stainless steel (SUS) was used as material of the developing sleeve.

An indefinite shape alumina particle (ARD) was used as grain, it was subjected to blast processing, the surface was subjected to rough surface processing, ten point average roughness Rz was about 10 μm, output of color images was repeated on the image forming apparatus, and the same evaluation was carried out.

Here, the thickness of the conductive resin film layer was changed, resin coat sleeves having different reflection coefficients were prepared and the same evaluation was carried out. FIG. 7 shows a result. In FIG. 7, a sleeve a has 18 μm thickness, a sleeve b has 15 μm thickness, a sleeve c has 10 μm thickness, a sleeve d has 5 μm thickness and a sleeve e has 3 μm thickness.

With respect to illumination light of toner density sensor color, a reflection output value of developer color on the developing sleeve at the time of initializing operation of developer density control is defined as A (1.0 V in this embodiment). A reflection output value of sleeve surface color in which a developer is not carried on the developing sleeve is defined as B. At that time, in this invention, it was found that a value of a ratio B/A is the optimal range of $0.3<B/A<2$. As shown in FIG. 7, if the value of the ratio B/Z is in a range of 0.31 to 1.98, even if a large number of image forming operations are repeated, a probability of erroneous detection of toner density is low, and excellent images could be output.

However, when the reflection output of the sleeve itself was too low and the ratio B/A is 0.1, it was erroneously detected that the toner density was low by the toner density sensor, control is adversely performed to increase the toner density, the charged amount of toner was lowered, and image failure such as white ground portion fog was generated.

When the reflection of the sleeve itself was too high and the ratio B/A was 2.4 or higher, control is performed to lower the toner density due to erroneous detection of the toner density sensor, and problems that so lid density was lowered and image density was thin were generated. When the ratio B/A was 3.62 or higher, the toner density sensor erroneously detected, control was performed to lower the toner density, and not only a problem that the image density was thin but also a problem that carrier was adhered was generated.

As described above, the toner density of a developer carried on the developing sleeve is detected by the light reflection type toner density sensor, and the developer density is controlled based on the detection result. A resin coat sleeve having reflection output of a developing sleeve itself with respect to illumination light of the toner density sensor having substantially equal resistance thin layer as that of the reflection output of the developer is used. With this, it was possible to prevent the erroneous detection of a toner density with respect to variation in a developer amount on the developing sleeve, to control so as to maintain the toner density in its appropriate state, and to output a stable image density.

FIG. 8 is a graph showing output characteristics when the consideration which is the same as that shown in FIG. 6 was carried out when the toner density sensor 30 is opposed between magnetic poles, i.e., between the developing main pole N1 of the development device and a conveyance pole S2 upstream in the driving direction of the developing sleeve 41. In this case, a resin coat sleeve does not have output variation in density sensor in a range where the amount of developer on the developing sleeve is 10 to 40 mg/cm$^2$.

However, in the case of the aluminum sleeve, if it becomes 20 mg/cm$^2$ or less, the output value is increased, and when the developer amount on the sleeve is 10 mg/cm$^2$, the output value of a developer of toner density of 4% becomes an output value that is equal to about 8%. When it is detected using the magnetic pole, the magnetic brush exists in a state where the ear stands by the developer on the developing sleeve, but when it is detected between the magnetic poles, it exists in a state where the ear falls and thus, an amount of developers at which the erroneous detection is prone to be generated is smaller as compared with detection on the magnetic pole.

However, the amount of developer is varied, it is erroneously detected that toner density which is reduced to 10 mg/cm$^2$ is high, and control is adversely performed so as to reduce the amount of toner supply to lower the developer density by the control of developer density.

As a result, problems that image density was thin and carrier was adhered were generated. On the other hand, the resin coat sleeve does not have any problem. It is important for developer density control to be able to precisely detect toner density irrespective of variation in developer amount carried on the developing sleeve. It was possible to detect toner density precisely even if it is opposed between the magnetic poles not only on the magnetic pole, and effect could be confirmed by the structure of the invention.

In this embodiment, the resin film layer is formed on the entire region where a developer of the developing sleeve is carried, but the same effect can be obtained of course even if the resin film layer is formed only in the detection region opposed to the toner density sensor.

In the embodiment, magnetic one-component developer was used as the developer accommodated in the black toner development device 6B, but non-magnetic one-component developer or two-component developer may be used.

Second Embodiment

Next, a second embodiment will be described. In the first embodiment, developer density was controlled based on the output of the light reflection type toner density sensor 30. In the second embodiment, density of a patch image formed on a photosensitive drum or an intermediate transfer belt is detected by a patch detection sensor instead of the light reflection type toner density sensor, and the developer density is controlled based on the output. The light reflection type toner density sensor is used as a toner density limiter. Since the structure of the main body is the same as that of the first embodiment, the same constituent members are designated with the same symbols and explanation thereof will be omitted.

In this embodiment, a reference patch image is formed on the intermediate transfer belt 8, it is detected by a patch detection sensor 31 provided so as to be opposed to the transfer belt, and patch detection ATR for controlling the developer density is carried.

Figure 9:
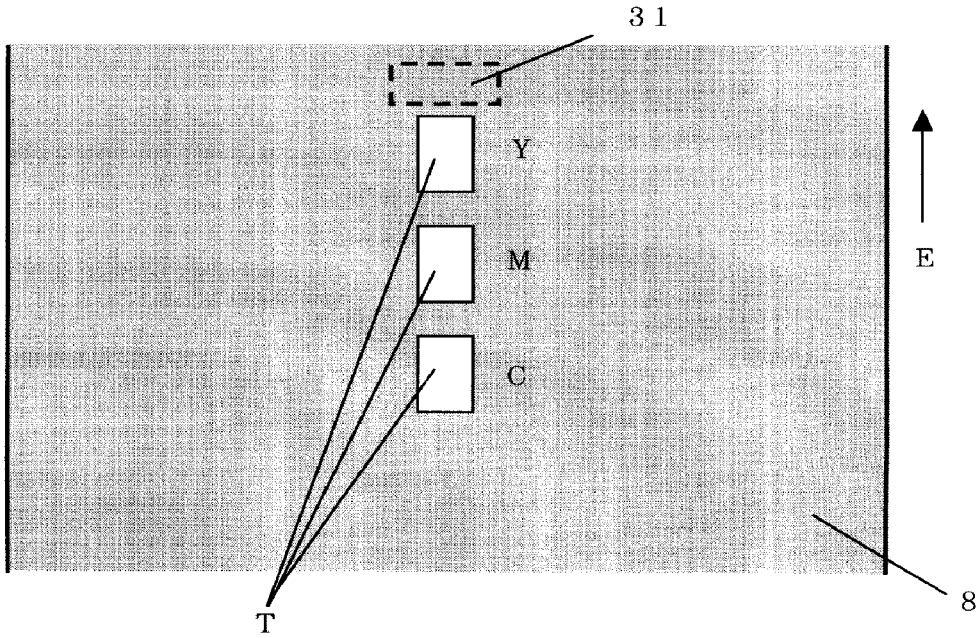
FIG. 9 is a diagram illustrating a patch image of developer density control according to another embodiment of the invention.

First, a reference patch latent image which becomes predetermined contrast voltage is formed on the photosensitive drum 1 by a test pattern generating unit mounted in a video controller (not shown), the electrostatic latent image is developed, and a patch image T as shown in FIG. 9 is formed. In the embodiment, such a reference patch that the contrast voltage of yellow, magenta and cyan becomes 120 V is used.

This is contract voltage in which a difference of density of the patch image appears most significantly with respect to the variation amount of toner density of a developer. The patch image T is primary transferred on the intermediate transfer belt 8. The patch images T of yellow, magenta and cyan are illuminated with LED (not shown) by the patch detection sensor 31 opposed to the intermediate transfer belt 8 downstream in the forward direction E of the intermediate transfer belt 8 by the primary transfer member 9, and reflection light is sequentially obtained. Toner density of dense and thin color developer of the patch image is estimated.

A patch image T whose reading operation has been completed passes through a secondary transfer portion by applying transfer bias of the same polarity as that of toner charged polarity of the patch image T to the secondary transfer member 10 and then, the patch image T is cleaned by an intermediate transfer cleaner 12.

If the density of the patch image is thinner than density at the time of initial setting, it is determined that the toner density in the developer is thin, and toner is supplied to increase the toner density. If the density of the patch image is dens on the contrary, it is determined that the toner density in the developer is dens and toner is supplied to reduce the toner density.

The supply of toner is controlled depending upon how much the toner in the color toner cartridges 7Y, 7M and 7C should be supplied into the color toner development devices 6Y, 6M and 6C.

The control of developer density by the patch detection sensor 31 is controlled by controlling the toner density such that the toner amount developed with respect to the predetermined developing contrast voltage becomes constant, and toner density of a developer is varied.

When forming operation of an image having low average image ratio is repeated, consumption and supply of toner are small, residence time of toner in the development device becomes long and thus, a charged amount of toner is increased by friction charging.

Then, since the density of the patch image becomes thin, toner is supplied and toner density is increased. However, if the image forming operation is repeated many times and toner density is increased and covering ratio of toner with respect to carrier is excessively increased, toner and carrier can not frictionally charged and toner having low charged amount is increased. If the toner density exceeds 12%, toner scatters and white ground fig is generated.

When forming operation of image having high average image ratio is repeated or when carrier is deteriorated due to wearing of coat layer of the carrier due to excessive image formation or carrier spent, the charging amount of toner is lowered. In this case, since the density of patch image becomes dense, toner is not supplied and toner density is lowered.

If the toner density became lower than 3%, image failure such as thin image density, rough image and adhesion of carrier was generated. Hence, toner density was detected by the light reflection type toner density sensor 30, it was used as the toner density limiter and supply of toner was controlled such that the toner density did not become lower than 3% or greater than 12%.

However, erroneous detection of the toner density sensor 30 occurs due to variation of the amount of developer carried on the developing sleeve 41. In this case, even if the toner density of developer is appropriately controlled by controlling the developer density by the patch detection sensor 31, error occurs because the light reflection type toner density sensor 30 goes out of the range of the toner density limiter.

In the image forming apparatus controlled in the above-described manner, a developing sleeve coated with resin like the first embodiment was used. With this, it was possible to prevent erroneous detection of toner density with respect to variation in developer amount, and to control the toner density within an appropriate range without exceeding upper and lower limits of the toner density.

It was possible to prevent image failures such as scattering of toner and white ground fag caused by excessively high toner density, and thin image density, rough image and adhesion of carrier caused by excessively low toner density. A problem that the toner density comes out from the range of toner density limiter to cause an error and emergency stop of the image forming apparatus is caused is not generated even though the toner density is in the appropriate range.

In this embodiment, the light reflection type toner density sensor and the patch detection sensor are used and the developer density is controlled in accordance with the detection output, but one of or both of an inductance sensor and a video count may also be used.

Third Embodiment

Next, a third embodiment will be described.

In the first embodiment, a resin film thin layer was formed on the surface of the developing sleeve. In the third embodiment, a surface of a developing sleeve is plated. Since a structure of a main body is the same as that of the first embodiment, the same constituent elements are designated with the same symbols and explanation thereof will be omitted.

In this embodiment, the following developing sleeve 41 was used. First, aluminum was used as a material of the developing sleeve, its surface was subjected to blast processing using indefinite shape alumina particle (ARD) as grain, and ten point average roughness Rz was about 12 μm.

Then, a film layer of electrolytic black nickel plating (Ni—Zn) was formed on a region of a surface of the aluminum sleeve subjected to the rough surface processing which carries and conveys the developer. A developing sleeve in which the ten point average roughness Rz was about 10 μm and output of the toner density sensor was 1.40 V when no developer existed on the developing sleeve was obtained.

The same evaluation as that of the first embodiment was carried out using this developing sleeve. As a result, the output of the toner density sensor was stable with respect to variation in the amount of developer carried on the developing sleeve and no erroneous detection occurred.

The developer density was controlled in the image forming apparatus, control to maintain the toner density in its appropriate state could be performed, and an image could be output with stable image density. A large amount of image forming operations was repeated in the image forming apparatus, and since the surface hardness became higher by the plating as compared with the resin coat, wearing of surface of the developing sleeve 41 was small, and lifetime thereof could be increased.

In this embodiment, a film layer of electrolytic black nickel was formed on the surface of the developing sleeve. The same effect could be obtained even if film layers were formed by electroless black Ni—P plating, electrolytic black chrome plating and electrolytic black Ni—Sn plating, and even if a developing sleeve was subjected to black coloring (iron oxide black film) treatment to lower the reflection coefficient.

Although the entire surface of the region of the developing sleeve which carries and conveys the developer is formed with the plating film layer in this embodiment, the same effect can be obtained of course even if only a region of the developing sleeve which is opposed to the toner density sensor is formed with the plating film layer.

Fourth Embodiment

Next, a fourth embodiment will be described based on FIGS. 10 and 11. In the first embodiment, the toner density of developer carried near the developing main pole N1 on the developing sleeve is detected by the toner density sensor disposed outside the development device. In the fourth embodiment, the toner density is detected by a toner density sensor disposed in the development device.

Figure 10:
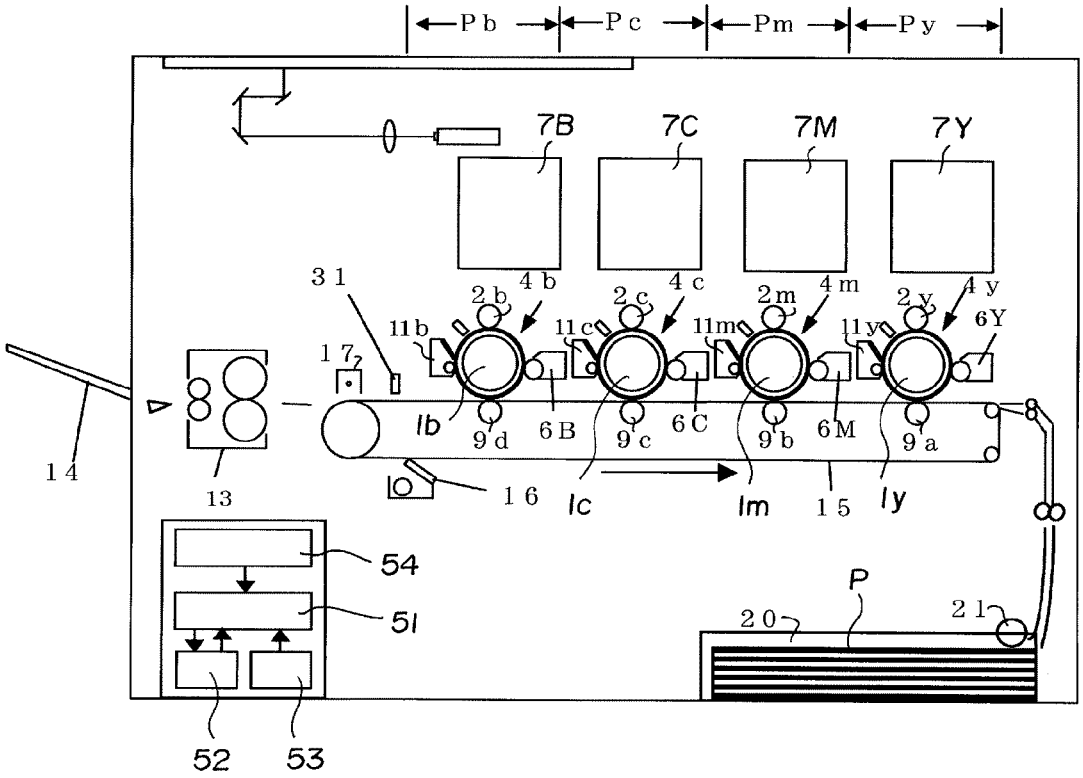
FIG. 10 is a schematic diagram illustrating a structure of an image forming apparatus according to another embodiment of the invention.
Figure 11:
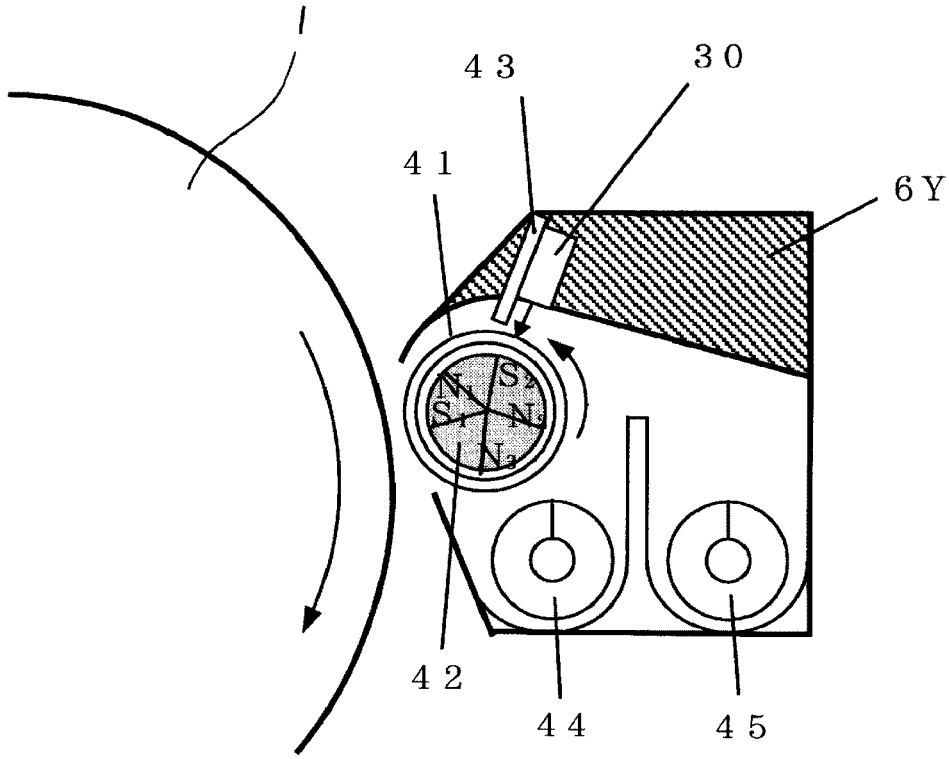
FIG. 11 is a sectional view of a development device illustrated in FIG. 10.

FIG. 10 is a sectional view showing an example of a tandem type direct transfer type color image forming apparatus showing a third embodiment of the present invention. In the apparatus, a transfer material bearing member (transfer belt 15, hereinafter) is wound around tension rollers.

The transfer belt 15 rotates in the direction of the arrow, and conveys a transfer material P carried on the transfer belt 15. First, second, third and fourth image forming portions Py, Pm, Pc and Pb are provided along the transfer belt 15, and yellow, magenta, cyan and black toner images are formed through latent image, developing and transferring processes.

The image forming portions Py, Pm, Pc and Pb respectively have image bearing members (photosensitive drums) 1*y*, 1*m*, 1*c* and 1*b*, and toner images of these colors are formed on the photosensitive drums 1*y*, 1*m*, 1*c* and 1*b*. The transfer belts 15 are disposed in adjacent to the photosensitive drums 1*y*, 1*m*, 1*c* and 1*b*, and the toner images of the colors formed on the photosensitive drums 1*y*, 1*m*, 1*c* and 1*b* are transferred onto the transfer material which is carried on the transfer belt 15 and conveyed. The transfer material P on which the toner image is transferred is separated from the transfer belt 15 by a separating charger 17, the toner image is fixed by heating and pressurizing the same by a fixing apparatus 13 and then, the image is discharged out from the apparatus as a record image.

Chargers, 2*y*, 2*m*, 2*c* and 2*b*, and exposure apparatuses 4*y*, 4*m*, 4*c* and 4*b* are provided on outer peripheries of the photosensitive drums 1*y*, 1*m*, 1*c* and 1*b*. Further, development devices 6*y*, 6*m*, 6*c* and 6*b*, transfer chargers 9*y*, 9*m*, 9*c* and 9*b*, and photosensitive drum cleaner 11*y*, 11*m*, 11*c* and 11*b* are provided.

A light source apparatus and a polygon mirror (not shown) are disposed above the apparatus. Laser light emitted from the light source apparatus is scanned by rotating the polygon mirror, and luminous flux of scanning light is deviated by the reflection mirror. Light is collected on generators of the photosensitive drums 1*y*, 1*m*, 1*c* and 1*b* by an fθ lens and exposed, and latent image in accordance with an image signal is formed on each of the photosensitive drums 1*y*, 1*m*, 1*c* and 1*b*.

A predetermined amount of developing material in which non-magnetic toner and magnetic carrier of yellow, magenta, cyan and black are mixed with a predetermined mixing ratio is charged into the development devices 6*y*, 6*m* 6*c* and 6*b*, respectively.

The development devices 6*y*, 6*m* 6*c* and 6*b* develop latent images on the photosensitive drums 1*y*, 1*m*, 1*c* and 1*b* and visualize the same as a yellow toner image, a magenta toner image, a cyan toner image and a black toner image.

The transfer material P is accommodated in a transfer material cassette 20, supplied onto the transfer belt 15 therefrom through a plurality of conveying rollers and registration rollers, and they are sequentially sent to transfer portions which are opposed to the photosensitive drums 1*y*, 1*m*, 1*c* and 1*b* by the transfer belts 15.

The transfer belt 15 is in an endless form or in a seamless form having no seam. The transfer belt 15 is rotated by a driving roller, the transfer material P is sent to the registration roller color transfer belt 15, and the transfer material P is conveyed toward the transfer portion of the first image forming portion Py. Simultaneously, an image writing signal is turned ON, and an image is formed on the photosensitive drum 1*y* of the first image forming portion Py at this timing. The transfer charger 9*y* gives an electric field or charge at the transfer portion below the photosensitive drum 1*y*, a toner image of the first color formed on the photosensitive drum 1*y* is transferred onto the transfer material P. With this transfer, the transfer material P is strongly held on the transfer belt 15 electrostatic absorption force, and it is conveyed to the second image forming portion Pm and subsequent image forming portions.

Images are formed and transferred by the second to fourth image forming portions Pm to Pb in the same manner as that of the first image forming portion Py. Next, the transfer material P on which toner images of four colors were transferred is removed in electricity and attenuated in electrostatic absorption force by the separating charger 17 downstream in the conveying direction of the transfer belt 15, and it is separated from a terminal of the transfer belt 15.

A transfer belt cleaning blade 16 is always in abutment against the transfer belt. The cleaning blade 16 cleans fog toner adhered to the surface of the transfer belt 15 and scattering toner downstream in the traveling direction of the transfer belt from the separating position from the transfer belt 15 of the transfer material P.

The separated transfer material P is conveyed to the fixing apparatus 13, colors of the toner image are mixed by fixing and the colors are fixed to the transfer material P, a full color is formed on a copy image, and is discharged into a discharge tray 14.

Toner remaining on the photosensitive drums 1*y*, 1*m*, 1*c* and 1*b* is cleaned by photosensitive drum cleaners 11*y*, 11*m*, 11*c* and 11*b* such as a fur brush and a blade.

Next, the development devices 6*y*, 6*m*, 6*c* and 6*b* will be described based on FIG. 11. FIG. 11 shows the developing sleeve 41, the magnet roller 42 fixed in the developing sleeve, stirring screws 44 and 45, and a limiting blade 43 disposed for forming a thin layer developer on the surface of the developing sleeve.

Here, a circulation system of the developer will be described. First, as the developing sleeve 41 rotates, the magnetic pole N2 pumps a developer, the developer is conveyed to the magnetic poles S2 and N1. In this process, the developing sleeve 41 is limited by the limiting blade 43 disposed at a gap S-B from the developing sleeve 41, and a thin layer is formed on the developing sleeve 41.

If the developer formed with the thin layer is conveyed to the developing main pole S1, a magnetic brush (ear) is formed by a magnetic force. A developer on the developing sleeve 41 on which the electrostatic latent image on the photosensitive drum 1 is developed by the ear-shaped magnetic brush is collected into the developing container by repulsion magnetic fields of the magnetic poles N3 and N2.

The same toner density sensors 30 as those of the first embodiment are provided in the development devices 6*y*, 6*m* and 6*c* so as to be opposed to the developing sleeve 41 before the limiting blade 43 in the rotation direction of the developing sleeve 41. Toner density is detected by the toner density sensor 30 with respect to developer immediately before a thin layer is formed by the limiting sleeve 43, and the developer density is controlled by the output.

The amount of developer at the detection position of the toner density sensor 30 is changed by an amount of developer pumped up from the stirring screw 44 by the pumping pole N2 of the developing sleeve, and by an amount of developer which is carried on the developing sleeve and which passes through the gap S-B. This is generated when the height of the developer surface near the stirring screw 44 is changed and a distance from the pumping pole N2 is changed, and when the flowability of developer is changed.

In the image forming apparatus having the above-described structure, the developing sleeve coated with the same resin coat as that of the first embodiment was used. As a result, like the first embodiment, it was possible to prevent erroneous detection of the toner density with respect to variation in the developer amount, and to control so as to maintain the appropriate state of the toner density, and to output an image with stable image density.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-260660, filed Oct. 4, 2007, which is hereby incorporated by reference herein in its entirety.

What is claimed is:

1. An image forming apparatus comprising an image bearing member, a development device which develops an electrostatic image formed on the image bearing member, a developer bearing member which is provided in the development device so as to be opposed to the image bearing member, and which carries a developer, a density sensor which emits light to the developer bearing member on the surface that carries the developer, and which can detect developer density on the developer bearing member by a reflection output value of the developer, and a supply device which supplies a supply developer to the development device in accordance with a detection result of the density sensor, wherein if a reflection output value detected by the density sensor in a state where the developer is carried on the developer bearing member is defined as A and a reflection output value detected by the density sensor in a state where the developer is not carried on the developer bearing member is defined as B, a value of B/A is in a range of $0.3<B/A<2$.

2. The image forming apparatus according to claim 1, wherein the density sensor is a diffused light type density sensor which detects diffused light from the developer.

3. The image forming apparatus according to claim 1, wherein the developer bearing member is provided at its surface with a layer including at least resin.

4. The image forming apparatus according to claim 1, wherein the developer bearing member is provided at its surface with a film layer formed by plating.

5. The image forming apparatus according to claim 1, wherein the reflection output value A is a detection result which is detected in a state where the developer is carried on the developer bearing member when the image forming apparatus is initially disposed or at the time of initial stage of exchange of the development device.

6. An image forming apparatus comprising:

a plurality of image bearing members;

a plurality of development devices which respectively develop electrostatic images formed on the image bearing members;

a plurality of developer bearing members which are respectively provided in the development devices, which are respectively opposed to the image bearing members, and which bear and convey developers;

a density sensor which emits light to a surface of each of the developer bearing members which carries the developer, and which can detect developer density on the developer bearing member by a reflection output value of the developer; and a plurality of supply apparatuses each of which supplies a supply developer to the development device in accordance with detection results of the density sensor, wherein if reflection output values when the developer bearing members are detected by the density sensor in a state where the developers are carried are defined as A, and reflection output values when the developer bearing members are detected by the density sensor in a state where the developers are not carried are defined as B, a value of B/A obtained for each of the developer bearing members is in a range of $0.3<B/A<2$.

* * * * *